US006326891B1

(12) United States Patent
Lin

(10) Patent No.: US 6,326,891 B1
(45) Date of Patent: Dec. 4, 2001

(54) WARNING DEVICE FOR PREVENTING CHILD FROM BEING LOST

(76) Inventor: Ching-Chi Lin, Rm901, No. 163, Sec. 1, Keelung Rd., Taipei (TW)

( * ) Notice: Subject to any disclaimer, the term of this patent is extended or adjusted under 35 U.S.C. 154(b) by 0 days.

(21) Appl. No.: 09/507,890

(22) Filed: Feb. 22, 2000

(51) Int. Cl.[7] ..... G08B 23/00
(52) U.S. Cl. ..... 340/573.4; 340/539
(58) Field of Search ..... 340/573.4, 573.3, 340/573.1, 539, 825.36

(56) References Cited

U.S. PATENT DOCUMENTS 5,646,593 * 7/1997 Hughes et al. ..... 340/573
5,841,352 * 11/1998 Prakash ..... 340/573
6,127,931 * 10/2000 Mohr ..... 340/573.4
6,150,928 * 11/2000 Murray ..... 340/426
6,169,485 * 1/2001 Campana, Jr. ..... 340/573.4

* cited by examiner

*Primary Examiner*—Daniel J. Wu
*Assistant Examiner*—Sihong Huang
(74) *Attorney, Agent, or Firm*—Dougherty & Troxell

(57) ABSTRACT

A compact warning device for preventing child from being lost comprises a high frequency distance-adjustable host transceiver and a plurality of slave transceivers wherein the high frequency host transceiver is carried by the parents and a high frequency slave transceiver is secured on a child, and the host and the slave transceivers can proceed bi-directional page or response with its counterpart. When one of the slave transceivers departs from the host transceiver beyond a preset security range, both the host and the slave transceiver will alarm to warn the child and the parents in order to prevent the child from being lost. Moreover, as this invention is capable of adjusting security range in multiple stages, it can fit various circumstantial conditions.

2 Claims, 6 Drawing Sheets

WARNING DEVICE FOR PREVENTING CHILD FROM BEING LOST

BACKGROUND OF THE INVENTION

1. Field of the Invention

This invention relates generally to a warning device, particularly to a warning device for preventing child from being lost comprising a distance-adjustable high frequency host transceiver and a plurality of associated high frequency slave transceivers, wherein the host transceiver and each slave transceiver can proceed bi-directional page or response with its counterpart.

2. Description of the Prior Art

"Prevention is better than cure" seems applicable by changing it into "Prevention is better than search" in dealing with child's security problem. It is undoubtedly a severe and beyond compensable disaster to a family when a child was lost, and the cloudy family will find no joy in daily living until the child is found back. This is especially true in recent days as a family usually raises only one or two children basing on eugenics concept. On the basis of demand, there are various equipments or devices for preventing child from being lost presented in the market.

One of the devices to be cited has been disclosed in Taiwan with patent No. 300659 (abbrev. as "the patent cited" hereinafter), which is characterized in comprising a host device carried by an adult and a slave device disposed in a personal item or on a child. When the slave device departs from the host device beyond a preset security distance, the latter will alarm to warn the carrier and it can be reset for another alarm when the former reenter the security scope for easy searching. As the patent cited has been developed on the basis of personal items, it is not equally suitable to a child who may go along with his or her parents to different places and under different situations, for example, to a market jammed with people. In case the security range cannot be adjusted within 2 meters, the child may get lost in a winking of an eye. Or, when the family goes out to a park, the security range is still within 2 meters, the mother can only sit aside her child instead of resting on a farther bench.

Moreover, the patent cited is applied on paired basis, namely, one host device to one slave device that will obviously entails more expense on the parents if they have several children.

In view of abovesaid demerits, after years of constant effort in research, the inventor of this invention has consequently developed and proposed an improved warning device pertaining to the subject matter.

SUMMARY OF THE INVENTION

The primary object of this invention is to provide a warning device for preventing child from being lost containing a high frequency host transceiver in which security range is adjustable to fit various circumstantial conditions for monitoring a child's activity.

Another object of this invention is to provide a compact warning device for preventing child from being lost, wherein a high frequency host transceiver is carried by the parents and a high frequency slave transceiver is secured on a child, and the host and the slave transceiver can proceed bi-directional page or response with its counterpart. When the slave transceiver departs from the host transceiver beyond a preset security range, both the host and the slave transceiver will alarm to warn the child and the parents.

Yet another object of this invention is to provide a warning device for preventing child from being lost, wherein a host transceiver can monitor a plurality of slave transceivers simultaneously.

A further object of this invention is to provide a warning device for preventing child from being lost, wherein a slave transceiver is designed lively in configuration to serve as an ornament for a child to wear.

Yet a further object of this invention is to provide a warning device for preventing child from being lost, wherein amount of slave transceiver may be expanded under permission of an encoder module for application in a school or in a traveling group.

For realizing abovesaid objects, the warning device for preventing child from being lost comprising a high frequency host transceiver and a plurality of high frequency slave transceivers. The host transceiver further comprises a single-chip microprocessor, a clock generator, a high frequency transmitter, a high frequency receiver, a distance controller, a warning unit, a power supply controller, a power supply unit, a power voltage detector, a display unit, a high frequency filter, a signal amplifier, and a voltage regulator. The slave transceiver further comprises a single-chip microprocessor, a clock generator, a high frequency transmitter, a high frequency receiver, a warning unit, a power supply controller, a power supply unit, a high frequency filter, a signal amplifier, and a voltage regulator. When the host transceiver send a signal to the slave transceiver, the latter will receive and confirm whether the code carried is correct, then reply to the host if positive, and both the host and the slave keep silent at this time. On the contrary, in case the slave depart from the host beyond a preset security range, both the host and the slave will alarm to remind its user of the abnormal situation.

As to more detailed information regarding this invention together with further advantages or features thereof, at least an example of preferred embodiment will be elucidated below with reference to the annexed drawings.

BRIEF DESCRIPTION OF THE DRAWINGS

The related drawings in connection with a detailed description of this invention hereunder are listed as follows in which.

DETAILED DESCRIPTION OF THE PREFERRED EMBODIMENT

Figure 1:
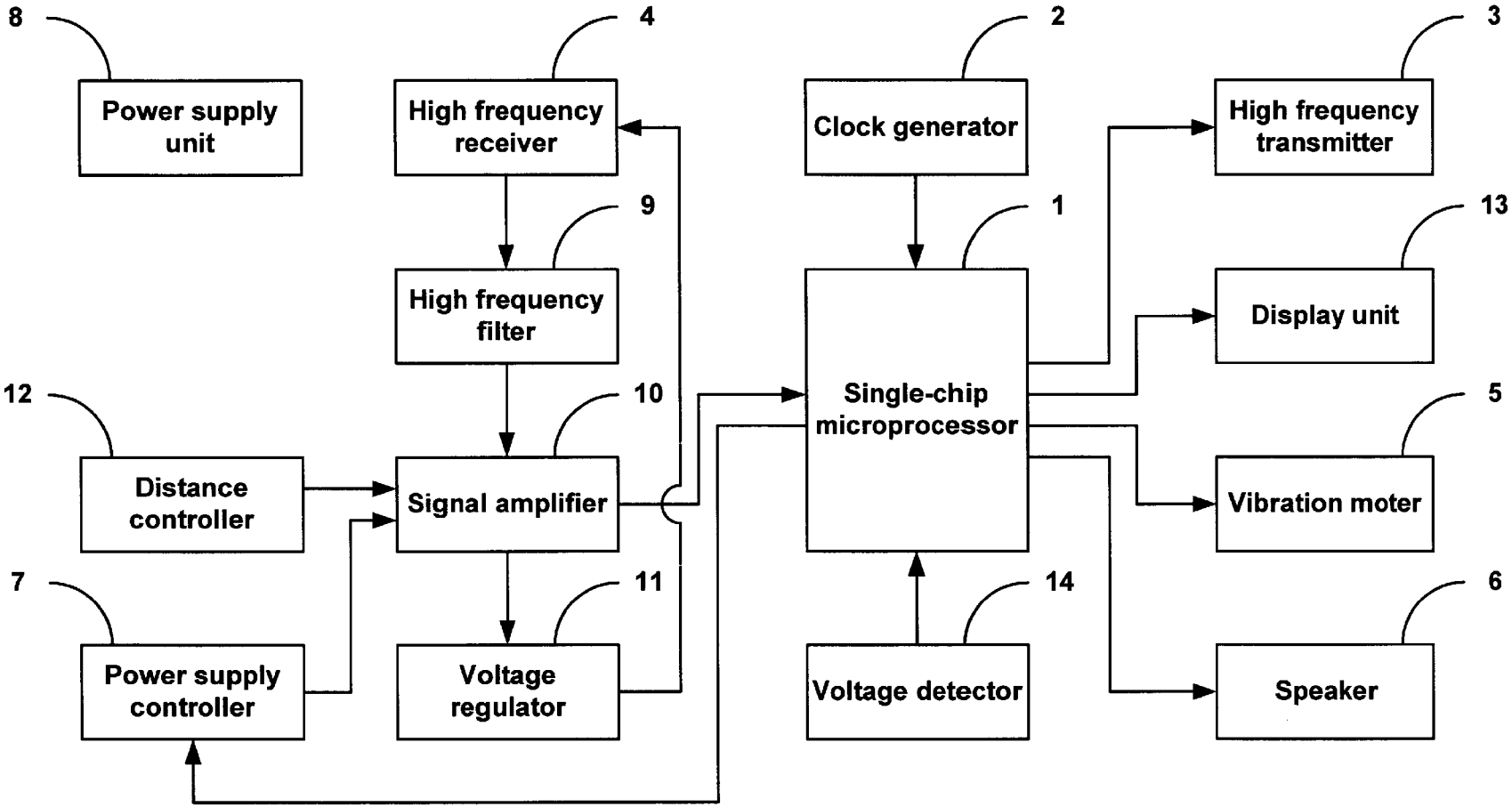
FIG. 1 is a block diagram of a high frequency host transceiver of this invention.
Figure 2:
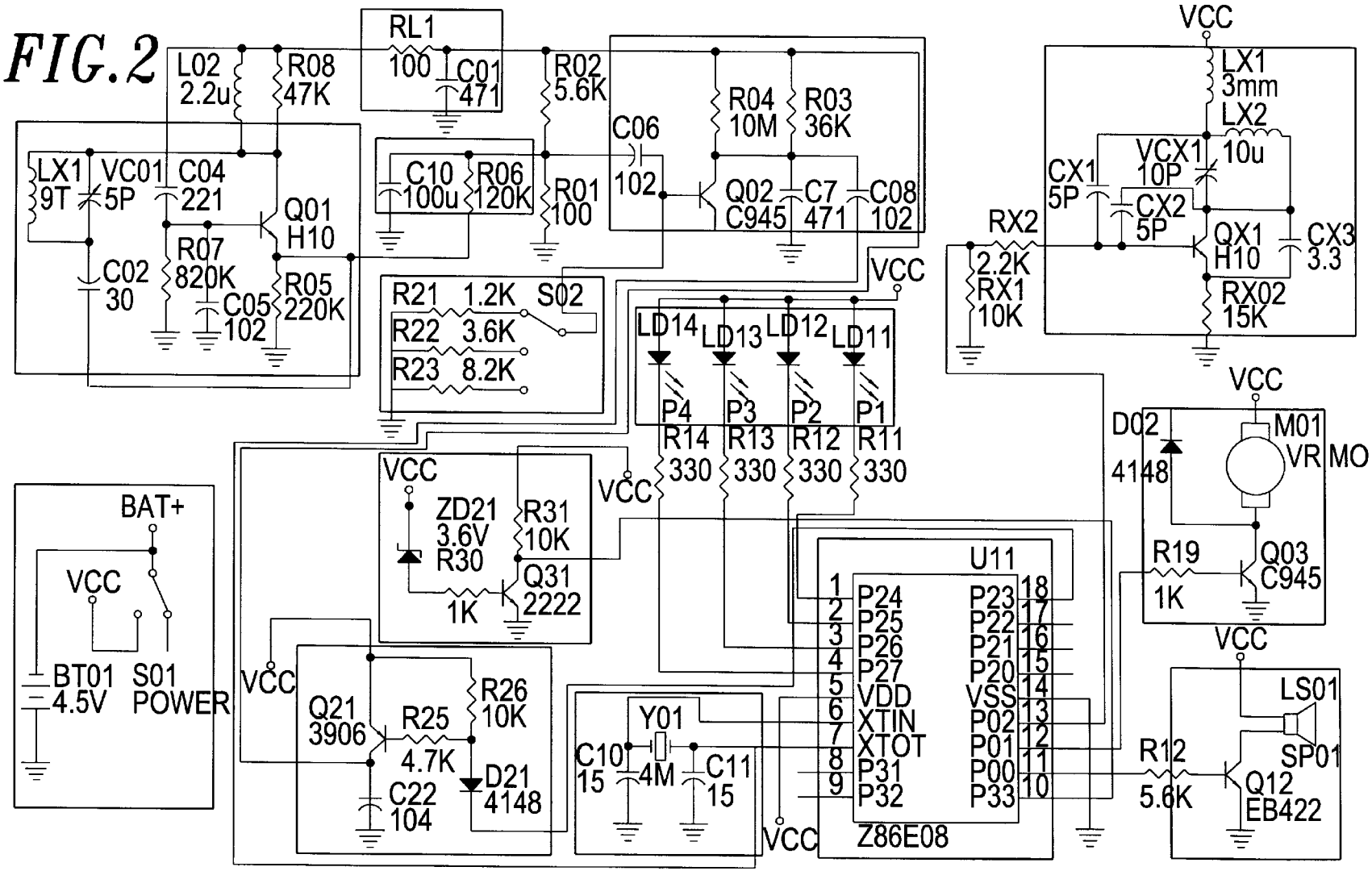
FIG. 2 is a circuit diagram of the high frequency host transceiver.

A warning device for preventing child from being lost comprises a host and a slave high frequency transceiver shown in FIG. 1 and FIG. 2.

The high frequency host transceiver further comprises: a single-chip microprocessor 1, a clock generator 2, a high frequency transmitter 3, a high frequency receiver 4, a warning unit, a power supply controller 7, a power supply unit 8, a high frequency filter 9, a signal amplifier 10, a voltage regulator 11, a distance controller 12, a display unit 13, and a voltage detector 14.

The single-chip microprocessor 1 is programmed to operate with associated hardware.

The clock generator 2 is used to provide clock pulse for the microprocessor 1.

The high frequency transmitter 3 is used to transmit signals to the slave transceiver.

The high frequency receiver 4 is used to receive signals transmitted from the slave transceiver and relay the signals to the following high frequency filter 9.

The warning unit including a vibration motor 5 and a speaker 6 will vibrate and sound when an effective output signal is activated by the microprocessor 1.

The power supply controller 7 is used to control action order of the high frequency transmitter 3 and the high frequency receiver 4 based on an output signal of the microprocessor 1.

The power supply unit 8 provides a 4.5V DC power to the host transceiver.

The high frequency filter 9 is used to filter an input signal received by the high frequency receiver 4, then relay it to the following signal amplifier 10.

The signal amplifier 10 is used to amplify an output signal from the high frequency filter 9, the distance controller 12, or the power supply controller 7, then relay the amplified signal to the microprocessor 1 or the voltage regulator 11.

The voltage regulator 11 is used to regulate voltage of the amplified signal from the signal amplifier 10 and feed back to the high frequency receiver 4 for stabilization.

The distance controller 12 may be preset in 3 stages, namely, 2 m, 4 m, and 8 m, for controlling transmission power of the host transceiver, or, to adjust in different stages according to respective distance between the host and each slave transceiver.

The display unit 13 contains 4 LEDs that represent 4 slave transceivers respectively. When a slave transceiver is located within the security range, the related LED is darkened; or it is lightened otherwise.

The voltage detector 14 is used for detecting voltage of the power supply unit 8 to make sure if it is still workable for the host transceiver.

Figure 3:
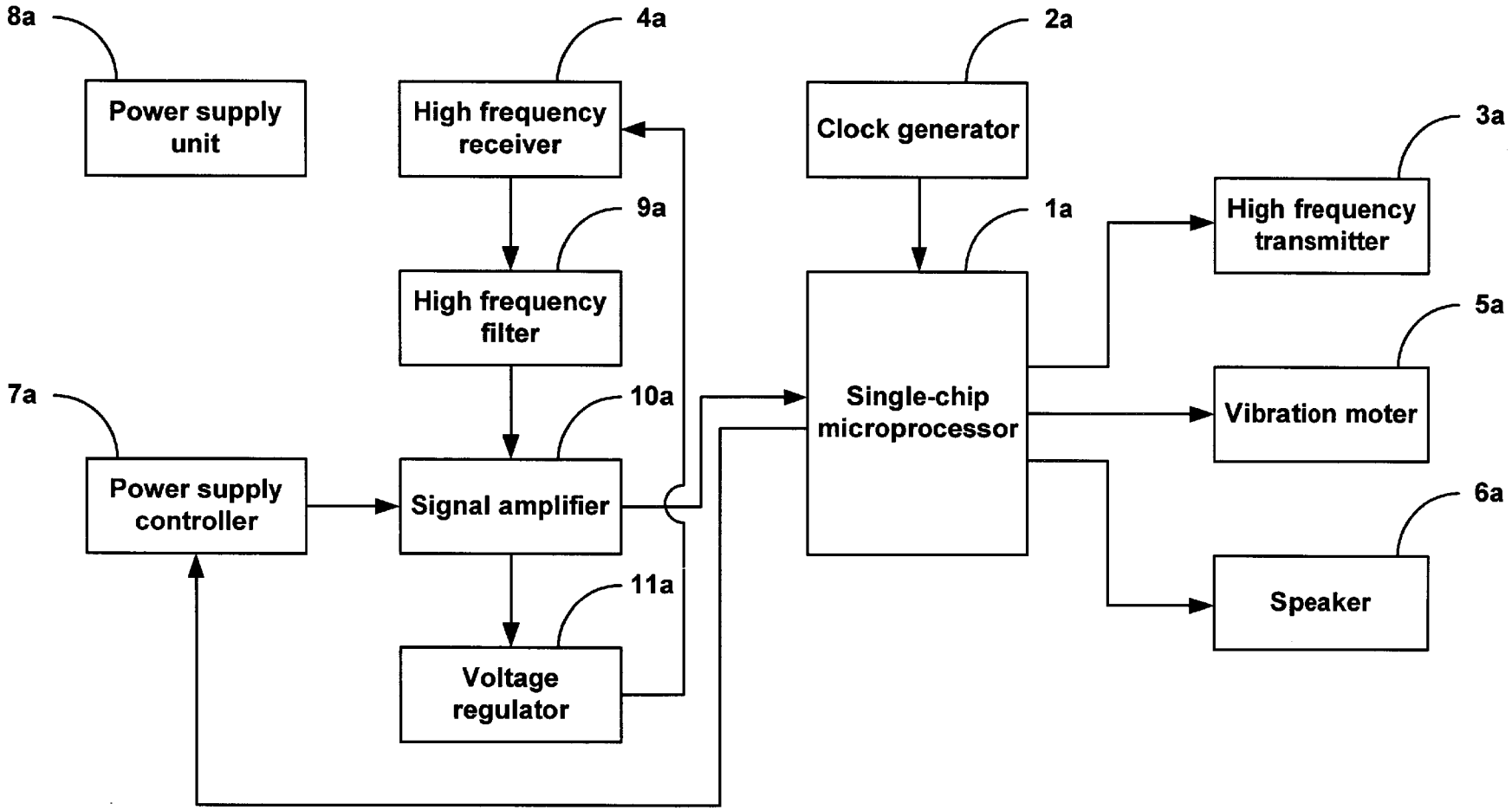
FIG. 3 is a block diagram of a high frequency slave transceiver of this invention.
Figure 4:
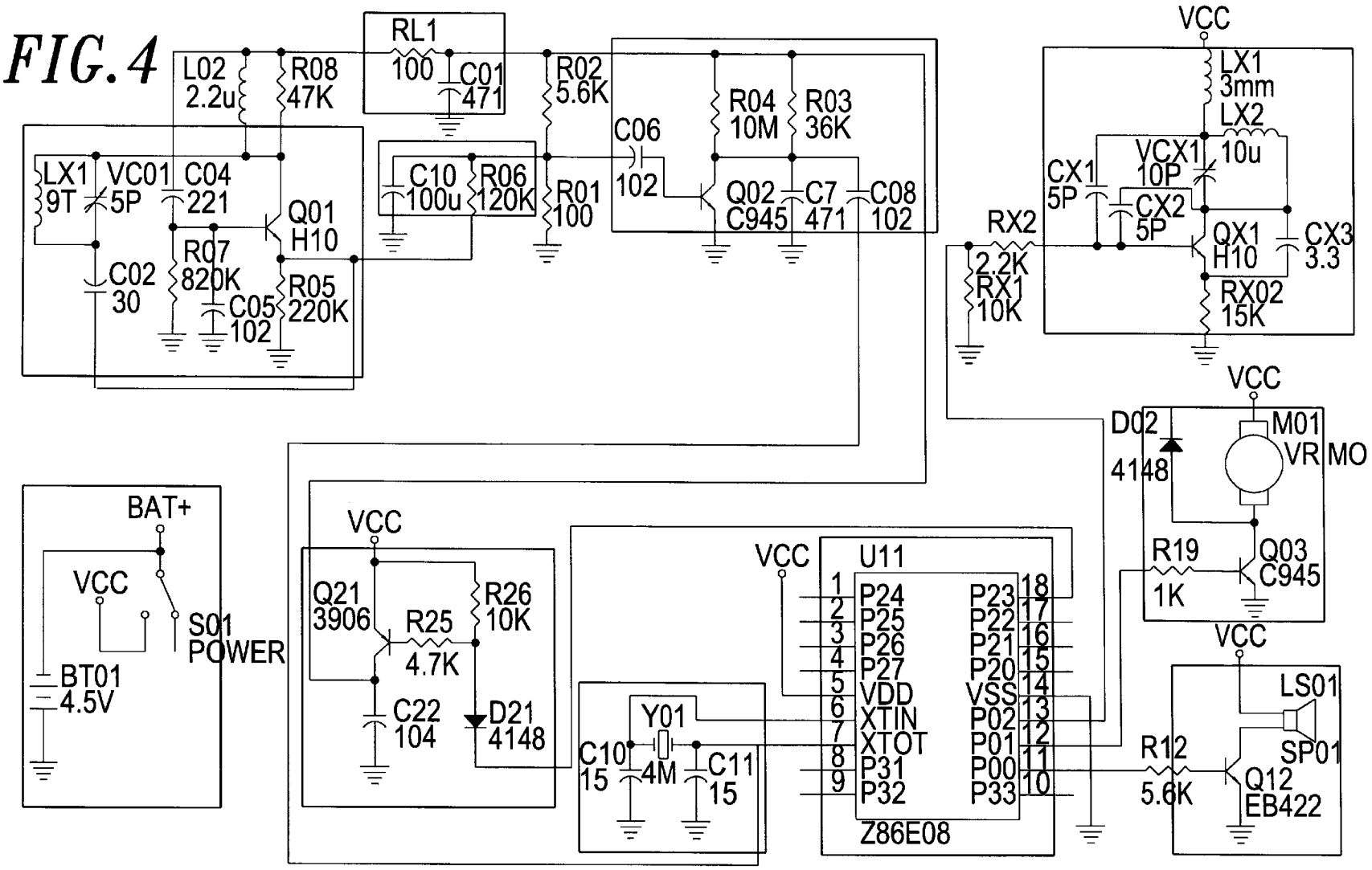
FIG. 4 is a circuit diagram of the high frequency slave transceiver.

As shown in FIG. 3 and FIG. 4, the high frequency slave transceiver further comprises a single-chip microprocessor 1*a,* a clock generator 2*a,* a high frequency transmitter 3*a,* a high frequency receiver 4*a,* a warning unit, a power supply controller 7*a,* a power supply unit 8*a,* a high frequency filter 9*a,* a signal amplifier 10*a,* and a voltage regulator 11*a.*

The single-chip microprocessor 1*a* is programmed to operate with associated hardware.

The clock generator 2*a* is used to provide clock pulse for the microprocessor 1*a.*

The high frequency transmitter 3*a* is used to transmit reply signals to the host transceiver.

The high frequency receiver 4*a* is used to receive signals transmitted from the host transceiver and relay the signals to the following high frequency filter 9*a.*

The warning unit including a vibration motor 5*a* and a speaker 6*a* will vibrate and sound when an effective output signal is activated by the microprocessor 1*a.*

The power supply controller 7*a* is used to control action order of the high frequency transmitter 3*a* and the high frequency receiver 4*a* based on an output signal of the microprocessor 1*a.*

The power supply unit 8*a* provides a 4.5V DC power to the slave transceiver.

The high frequency filter 9*a* is used to filter an input signal received by the high frequency receiver 4*a,* then relay it to the following signal amplifier 10*a.*

The signal amplifier 10*a* is used to amplify an output signal from the high frequency filter 9*a* or the power supply controller 7*a,* then relay the amplified signal to the microprocessor 1*a* or the voltage regulator 11*a.*

The voltage regulator 11*a* is used to regulate voltage of the amplified signal from the signal amplifier 10*a* and feed back to the high frequency receiver 4 a for stabilization.

In using abovesaid warning device, the host transceiver is carried by the parents while the slave transceiver is secured to a child. When the host transceiver send a signal to the slave transceiver, the latter will receive and confirm whether the code carried is correct, then reply to the host if positive, and both the host and the slave keep silent at this time. On the contrary, in case the slave depart from the host beyond a preset security range, both the host and the slave will alarm to remind its user of the situation.

Moreover, the security range of this invention is adjustable in multiple stages (2 m, 4 m, and 8 m). For example, if it is preset at 2 m, both the host and the slave transceiver will alarm at the moment the child departs from the parents more than 2 m, then the parents may readjust the security range from 2 m to 8 m to confirm whether their child is located out of the maximum security range or not.

The action chart of the host and the slave transceiver are respectively described below.

Figure 5:
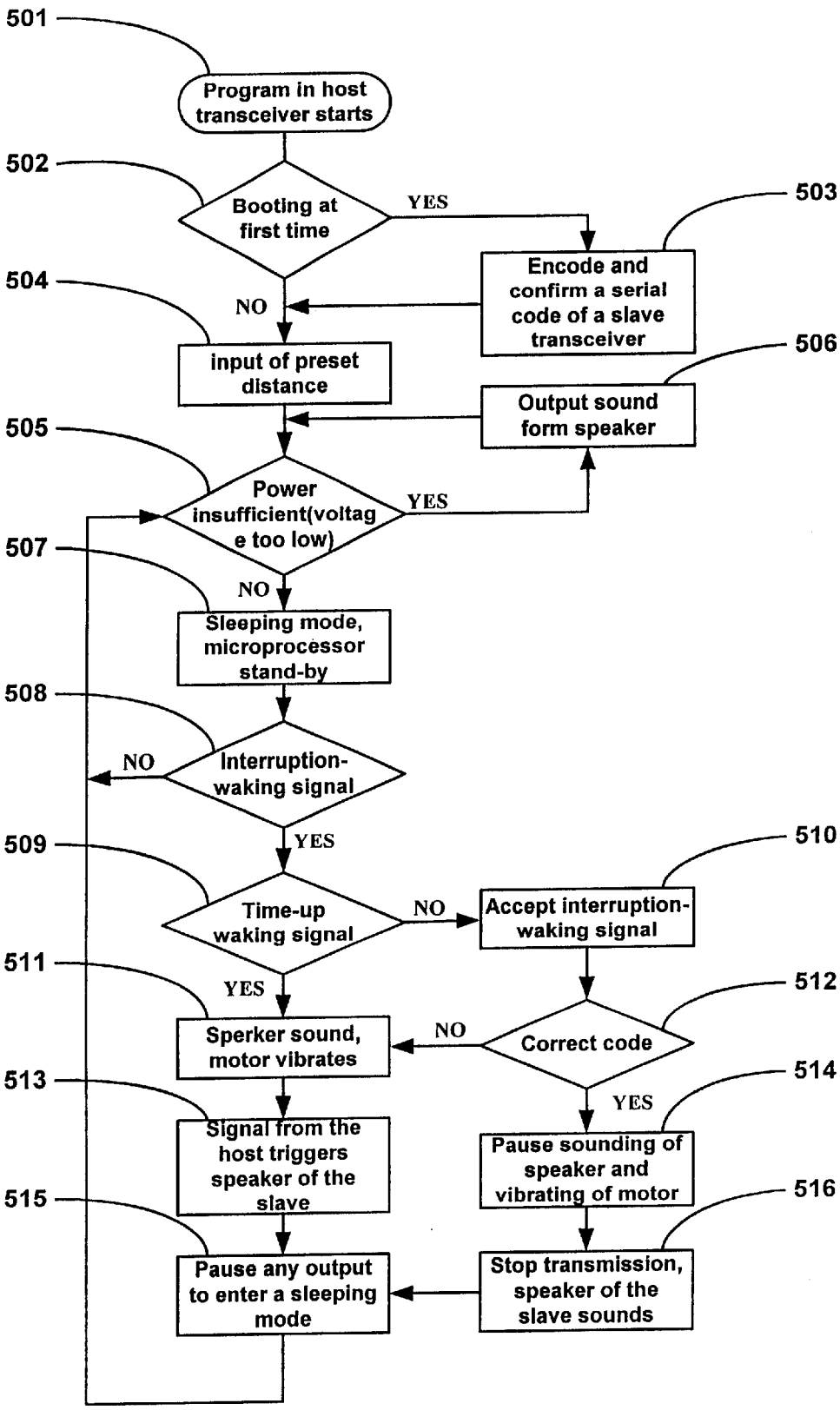
FIG. 5 is an action chart of the high frequency host transceiver.

As shown in FIG. 5, the program in the host transceiver starts 501 and goes stepwise:

1. To judge if booting the first time 502? To encode and confirm a serial code of the slave transceiver 503 if "YES" or preset distance for input otherwise 504.
2. To detect if voltage too low (power insufficient) 505? To trigger the speaker for warning 506 if "YES" or enter a sleeping mode 507 otherwise and allow the microprocessor to idle in a stand-by state.
3. To judge if an interruption-waking signal available 508? To return to detect if power insufficient 505 if "NO", otherwise, judge if the interruption-waking signal a time-up interruption?
4. To trigger the speaker for sounding and the motor for vibrating 511 if "YES" and transmit a signal to the slave transceiver to trigger the speaker thereof 513, then pause any output to enter a sleeping mode 515 and jump to detect if power insufficient 505?
5. To accept the interruption-waking signal otherwise 510 and judge if the received code correct 512? To trigger the speaker for sounding and the motor for vibrating 511 if "NO" and transmit a signal to the slave transceiver to trigger the speaker thereof 513, then pause any output to enter a sleeping mode 515 and jump to detect if power insufficient 505? Otherwise, to pause action of the speaker and the motor 514 and transmit a signal to the slave transceiver to stop the speaker thereof 516 and pause any output to enter the sleeping mode 515, then jump to detect if power insufficient 505?

Figure 6:
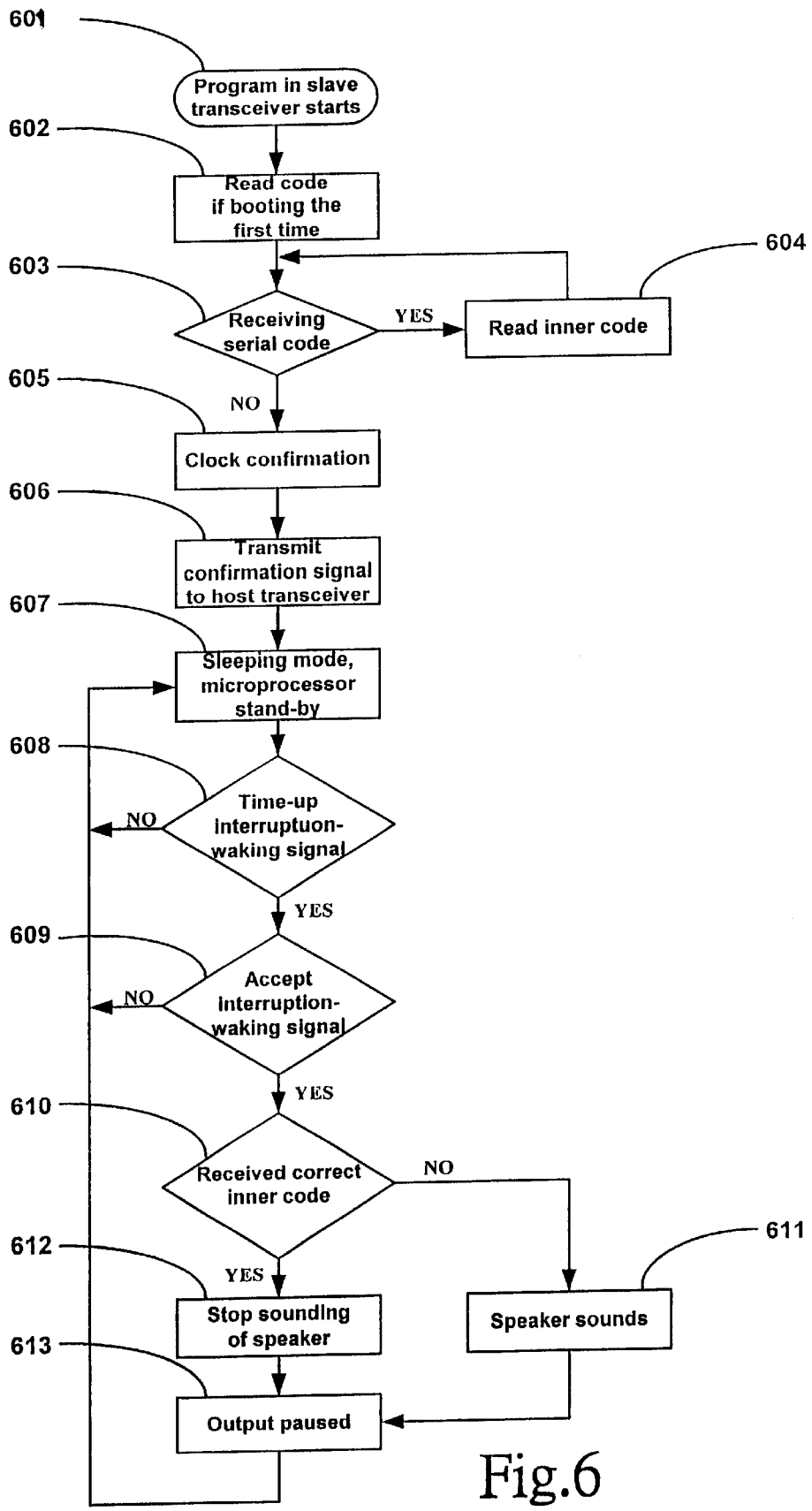
FIG. 6 is an action chart of the high frequency slave transceiver.

As shown in FIG. 6, the program in the slave transceiver starts 601 and goes stepwise:

1. To read code 602 if booting the first time, then judge if serial number has been received 603?
2. To read internal code 604 if "YES", or confirm the clock 605 otherwise and transmit a confirmation signal to the host transceiver 606, then enter a sleeping mode to allow the microprocessor to idle in a stand-by state 607.

3. To judge if a time-up interruption-waking signal available 608? To jump back to the stand-by state 607 if "NO", otherwise, to judge if an interruption-waking signal for receiving 609?
4. To jump back to the stand-by state 607 if "NO", or judge if the internal code is correct 610?
5. To trigger the speaker for sounding if incorrect, and cancel output 613 to jump back the stand-by state 607, or, to stop the speaker 612 and cancel the output 613 to jump back to the stand-by state 607.

The merits of the warning device of this invention for preventing child from being lost in comparison with the patent cited or other equivalents may be summarized as follows:

1. The high frequency host transceiver of this invention is capable of multi-stage distance adjustment to fit various circumstantial conditions for monitoring a child in better efficiency.
2. The high frequency host and slave transceiver can communicate in bidirections, hence, when the slave transceiver worn on a child departs from the host transceiver carried by the parents beyond a preset security range, the host transceiver will alarm in time to warn the parents.
3. The host transceiver is workable with a plurality of slave transceivers so that the parents can monitor several kids simultaneously.
4. The slave transceiver of this invention is designed lively in configuration to serve as an ornament for a child to wear.
5. The amount of the slave transceiver may be expanded under permission of an encoder module for application in a school or in a traveling group.

In the above described, at least one preferred embodiment has been elucidated with reference to drawings annexed, it is apparent that numerous variations or modifications may be made without departing from the true spirit and scope thereof, as set forth in the following claims.

What is claimed is:

1. A warning device for preventing a child from being lost comprising a high frequency host transceiver and a plurality of high frequency slave transceivers, wherein said host transceiver is adjustable in multi-stage security range from bi-directional communication with each slave transceiver; said host transceiver is basically carried by the parents while each slave transceiver is secured on a child respectively, when said slave transceiver has received a signal and confirmed an inner code sent from said host transceiver, said slave transceiver will in response transmit a reply signal to said host transceiver as a confirmation of receipt of the signal from said host transceiver, and no warning alarm will be triggered at this time; and, on the contrary, when said slave transceiver departs from said host transceiver beyond the present security range, both said host and said slave transceiver will start alarming to warn both ends for preventing the child from being lost wherein said high frequency host transceiver comprises:

a single-chip microprocessor which is programmed to operate with associated hardware;

a clock generator used to provide clock pulse for the microprocessor;

a high frequency transmitter used to transmit signals to said slave transceiver;

a high frequency receiver used to receive signals transmitted from said slave transceiver and relay the signals to a following high frequency filter;

a warning unit including a vibration motor and a speaker, which will vibrate and sound when an effective output signal is activated by said microprocessor;

a power supply controller used to control action order of said high frequency transmitter and said high frequency receiver based on an output signal of said microprocessor;

a power supply unit used to provide a 4.5 V DC power to said host transceiver;

a high frequency filter used to filter an input signal received by said high frequency receiver, then relay it to a following signal amplifier;

a signal amplifier used to amplify an output signal from said high frequency filter, a distance controller, or said power supply controller, then relay the amplified signal to said microprocessor or a following voltage regulator;

a voltage regulator used to regulate voltage of an amplified signal from said signal amplifier and feed back to said high frequency receiver for stabilization;

a distance controller used to preset distance in 3 stages, namely, 2 m, 4 m and 8 m, for controlling transmission power of said host transceiver, or, to adjust in different stages according to respective distance between said host transceiver and each said slave transceiver;

a display unit containing a plurality of LEDs which represents a plurality of slave transceivers respectively and when slave transceiver is located within the preset security range, the corresponding LED is darkened, or it is lightened otherwise; and a voltage detector used for detecting voltage of said power supply unit to make sure if it is still workable for said host transceiver.

2. A warning device for preventing a child from being lost comprising a high frequency host transceiver and a plurality of high frequency slave transceivers, wherein said host transceiver is adjustable in multi-stage security range from bi-directional communication with each slave transceiver; said host transceiver is basically carried by the parents while each slave transceiver is secured on a child respectively, when said slave transceiver has received a signal and confirmed an inner code sent from said host transceiver, said slave transceiver will in response transmit a reply signal to said host transceiver as a confirmation of receipt of the signal from said host transceiver, and no warning alarm will be triggered at this time; and, on the contrary, when said slave transceiver departs from said host transceiver beyond the present security range, both said host and said slave transceiver will start alarming to warn both ends for preventing the child from being lost wherein said high frequency slave transceiver comprises:

a single-chip microprocessor which is programmed to operate with associated hardware;

a clock generator used to provide clock pulse for said microprocessor;

a high frequency transmitter used to transmit reply signals to said host transceiver;

a high frequency receiver used to receive signals transmitted from said host transceiver and relay signals to a following high frequency filter;

a warning unit including a vibration motor and a speaker which will vibrate and sound when an effective output signal is activated by said microprocessor;

a power supply controller used to control action order of said high frequency transmitter and said high frequency receiver based on an output signal of said microprocessor;

a power supply unit used to provide a 4.5 V DC power to said slave transceiver;

a high frequency filter used to filter an input signal received by said high frequency receiver, then relay it to a following signal amplifier;

a signal amplifier used to amplify an output signal from said high frequency filter or said power supply controller, then relay the amplified signal to said microprocessor or a voltage regulator; and a voltage regulator used to regulate voltage of said amplified signal from said signal amplifier and feed back to said high frequency receiver for stabilization.

* * * * *